US006897835B2

(12) United States Patent
Irie et al.

(10) Patent No.: US 6,897,835 B2
(45) Date of Patent: May 24, 2005

(54) METHOD PROVIDING PREDETERMINED DISPLAY QUALITY OF COLOR IMAGES REGARDLESS OF TYPE OF INPUT IMAGE

(75) Inventors: Katsuya Irie, Kawasaki (JP); Kenji Awamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 110 days.

(21) Appl. No.: 09/988,207

(22) Filed: Nov. 19, 2001

(65) Prior Publication Data

US 2003/0025708 A1 Feb. 6, 2003

(30) Foreign Application Priority Data

Jul. 31, 2001 (JP) ..... 2001-232246 U

(51) Int. Cl.[7] ..... G09G 3/28
(52) U.S. Cl. ..... 345/63; 345/690; 315/169.4
(58) Field of Search ..... 345/60–72, 690; 315/169.4; 313/581–585

(56) References Cited

U.S. PATENT DOCUMENTS 5,107,353 A * 4/1992 Okumura ..... 345/96
5,579,027 A * 11/1996 Sakurai et al. ..... 345/100
5,659,226 A * 8/1997 Shigeta ..... 313/491
5,825,128 A 10/1998 Betsui et al.
5,982,347 A * 11/1999 Shigeta et al. ..... 345/88
6,376,986 B1 * 4/2002 Takagi et al. ..... 313/582

FOREIGN PATENT DOCUMENTS

JP 9-50768 2/1997
JP 11-288250 10/1999

* cited by examiner

*Primary Examiner*—Amr A. Awad
(74) *Attorney, Agent, or Firm*—Staas & Halsey LLP

(57) ABSTRACT

A method for displaying a color image is provided in which a predetermined display quality is secured regardless of a type of an input image, and display quality of an image having a linear edge is improved. The method comprises the steps of using a display device having a cell arrangement structure in which cells of each cell column in a display screen have the same light color, a light color of a cell column is different from that of the neighboring cell column, and a cell position in the column direction of a cell column is shifted from that of the neighboring cell column among a set of the cell columns each having the same light color, and lighting two neighboring cells in at least one cell column out of a set of cell columns each having the same light color when displaying a display line perpendicular to the column direction.

11 Claims, 7 Drawing Sheets

METHOD PROVIDING PREDETERMINED DISPLAY QUALITY OF COLOR IMAGES REGARDLESS OF TYPE OF INPUT IMAGE

BACKGROUND OF THE INVENTION

1. Field of the Invention

The present invention relates to a method for displaying a color image. The method is especially suitable for a display using a plasma display panel (PDP).

Recently, a high quality image has been expedited in a television or a computer monitor. It is desired to realize a display device that can produce a high quality image regardless of a type of the image such as a nature image or a character image.

2. Description of the Prior Art

As a large screen display device, a surface discharge format AC type PDP is commercialized. The surface discharge format means a structure in which first and second display electrodes that are anodes and cathodes in display discharge for securing luminance are arranged in parallel on a front substrate or on a back substrate. A three-electrode structure is popular as an electrode matrix structure of the surface discharge type PDP, in which address electrodes are arranged in cross with display electrode pairs. One of the display electrodes (second display electrode) is used as a scan electrode for selecting a display line, and address discharge is generated between the scan electrode and the address electrode, so that addressing is performed in which wall charge is controlled in accordance with display contents.

Japanese unexamined patent publication No. 9-50768 discloses a modified stripe partition structure of the three-electrode surface discharge type PDP, in which plural band-like partitions that divide a discharge space in the display line (row) direction of the screen (usually in the horizontal direction) are meandered regularly, so that discharge interference in the column direction of the screen (usually in the vertical direction) can be avoided. Two neighboring partitions define a column space, which has wide portions and narrow portions arranged alternately. The position of the wide portion in a row is shifted from that in the neighboring row, and a cell is formed at each of the wide portions. Red, green and blue fluorescent materials for a color display are arranged such that one of the three color fluorescent materials is disposed at each column space and that neighboring column spaces have different light emission colors. The arrangement of the three color fluorescent materials is so-called delta arrangement (Delta Tri-color Arrangement). In the delta arrangement, width of a cell is larger than one third of a pixel pitch in the display line direction, so a numeric aperture is larger, and a higher luminance display can be realized than in a square arrangement. It is not necessary to set the display line direction to be the horizontal direction. The vertical direction can be the display line (row) direction and the horizontal direction can be the column direction.

Conventionally, in a color image display using a delta arrangement type PDP, each of the display lines is made of cells each of which is selected fixedly from cells in each of the columns along the address electrodes.

Conventionally, there are two phenomena as follows, which make display unnatural.

(1) Since a position of a cell is shifted in the vertical direction from that of the neighboring cell, a line displayed in the horizontal direction is viewed like a zigzag line.

(2) When displaying a line inclined toward the horizontal direction and the vertical direction, the distance between the light emission cells is not constant.

SUMMARY OF THE INVENTION

An object of the present invention is to secure predetermined display quality regardless of a type of an input image. Another object is to improve display quality of an image having a linear edge.

A method according to the present invention comprises the steps of using a display device including a display screen having parallel cell columns, cells of each cell column having the same light color, a light color of a cell column being different from that of the neighboring cell column, a cell position in the column direction of a cell column being shifted from that of the neighboring cell column among a set of the cell columns each having the same light color, and determining luminance of each cell of the display screen by distributing a luminance value of each pixel of an input image to plural cells corresponding to the pixel or by integrating luminance values of plural pixels of the input image into a cell corresponding to the pixel in accordance with a cell position relationship between an imaginary display screen having a cell arrangement corresponding to a pixel arrangement of the input image and the display screen.

In addition, when displaying a display line perpendicular to the column direction, two neighboring cells are lighted in at least one cell column having the same light color.

DESCRIPTION OF THE PREFERRED EMBODIMENTS

Hereinafter, the present invention will be explained more in detail with reference to embodiments and drawings.

Figure 1:
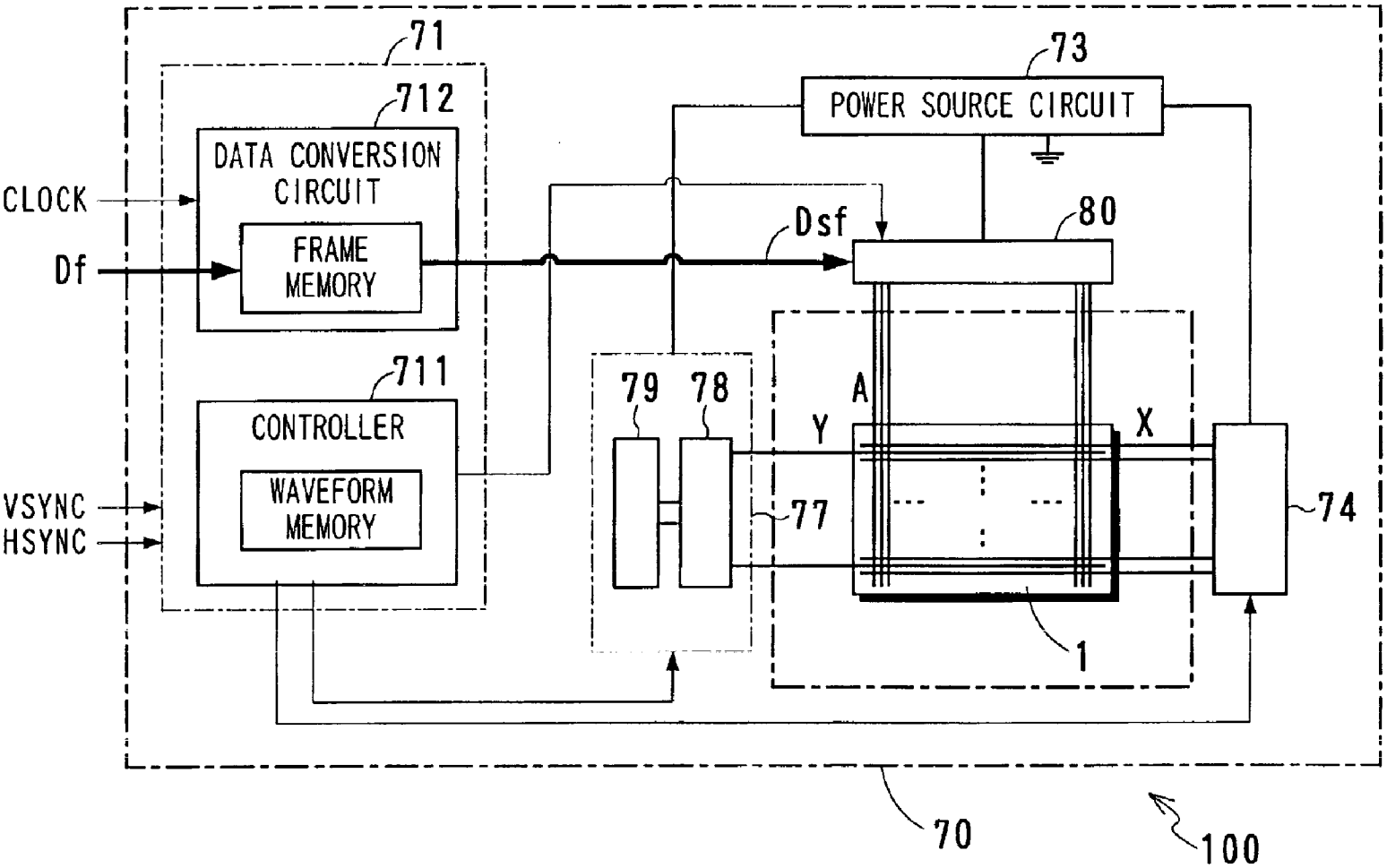
FIG. 1 shows a structure of a display device in accordance with the present invention.

FIG. 1 shows a structure of a display device in accordance with the present invention. The display device 100 comprises a three-electrode surface discharge format AC type PDP 1 including a display screen having m×n cells and a drive unit 70 for controlling cells selectively to emit light. The display device 100 is used as a wall-hung television or a monitor of a computer system.

The PDP 1 includes display electrodes X and Y for generating display discharge on the same substrate and address electrodes A arranged so as to cross the display electrodes. The total (n+1) of display electrodes X and Y extend in the horizontal direction of the display screen. Two neighboring display electrodes X and Y make a pair for generating surface discharge and define a display line in the screen. Each of the display electrodes except both ends of the arrangement works for two display lines (an odd display line and an even display line), while the display electrode of each end works for one display line. The display electrode Y is used as a scan electrode for selecting a line in the addressing.

The drive unit 70 includes a control circuit 71 for controlling the drive, a power source circuit 73, an X driver 74, a Y driver 77 and an address driver 80. The control circuit 71 includes a controller 711 and a data conversion circuit 712. The controller 711 includes a waveform memory for memorizing control data of drive voltage. The X driver 74 switches potential of the display electrode X. The Y driver 77 includes a scan circuit 78 and a common driver 79. The scan circuit 78 is potential switching means for selecting a display line in the addressing and controls potential of the display electrode Y individually. The common driver 79 switches potential of the display electrode Y. The address driver 80 switches potential of total m of address electrodes A in accordance with subframe data Dsf. These drivers are supplied with a predetermined power from the power source circuit 73.

The drive unit 70 is supplied with frame data Df that are multivalued image data indicating luminance levels of red, green and blue colors along with synchronizing signals CLOCK, VSYNC and HSYNC from an external device such as a TV tuner or a computer. The frame data Df are stored temporarily in a frame memory within the data conversion circuit 712 and are converted into the subframe data Dsf for a gradation display, which are transmitted to the address driver 80. The subframe data Dsf are q-bit display data indicating q subframes (i.e., a set of display data of q screens including subpixels each of which is defined by one bit), and the subframe is a binary image having resolution of m×n. The value of each bit of the subframe data Dsf indicates whether the subpixel of the corresponding one subframe is lighted or not, more precisely whether the address discharge is needed or not.

Figure 2:
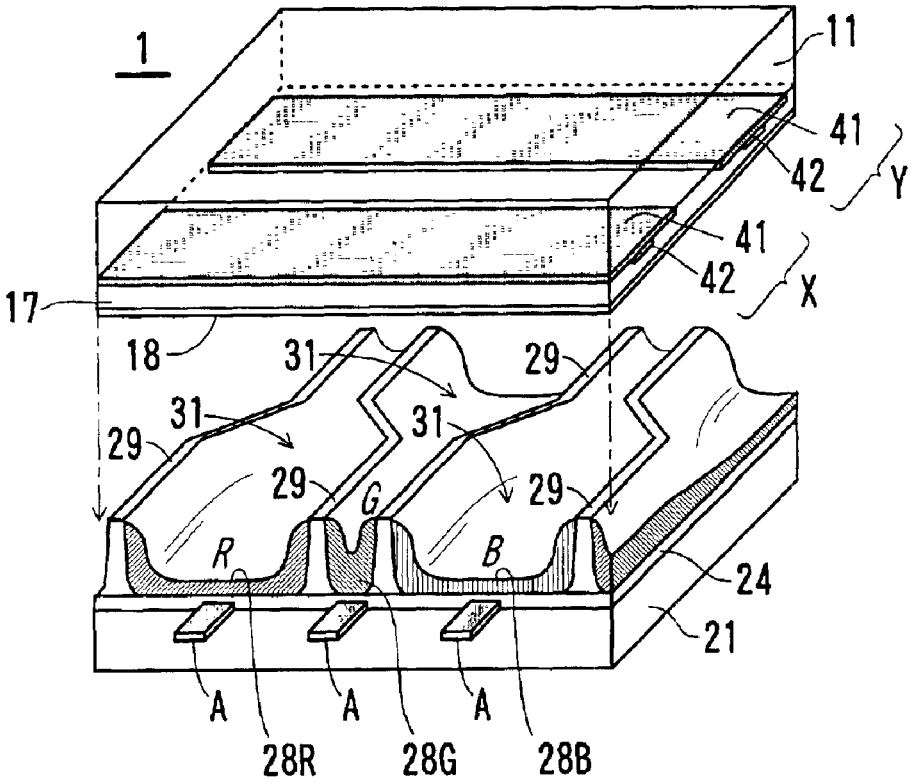
FIG. 2 shows a cell structure of a PDP according to the present invention.
Figure 3:
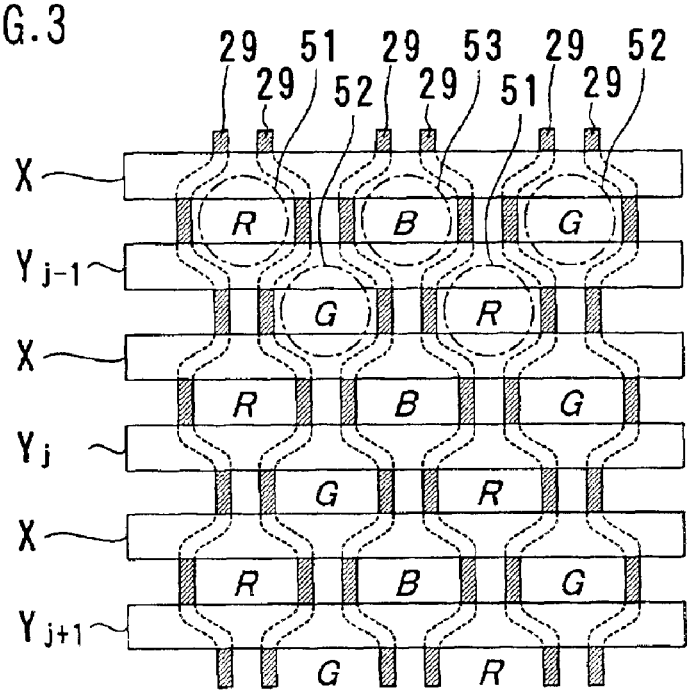
FIG. 3 shows a partition pattern.

FIG. 2 shows a cell structure of a PDP according to the present invention. FIG. 3 shows a partition pattern. As shown in FIG. 3, the reference letter "Y" of the display electrode Y is suffixed in order to indicate an arrangement order.

The PDP 1 comprises a pair of substrate structures (including a substrate on which components of cells are arranged). In the cell that constitutes a display screen, a pair of display electrodes X and Y and an address electrode A cross each other. The display electrodes X and Y are arranged on the inner surface of the front glass substrate 11, and each of the display electrodes X and Y includes a transparent conductive film 41 and a metal film (a bus electrode) 42. The display electrodes X and Y are covered with a dielectric layer 17, and magnesia (MgO) is used as a protection film 18 that covers the surface of the dielectric layer 17. The address electrodes A are arranged on the inner surface of the back glass substrate 21 and are covered with a dielectric layer 24. On the dielectric layer 24, a meandering band-like partition 29 having a height of approximately 150 microns is disposed at each of spaces between the address electrodes A. The partitions 29 divide the discharge space along the horizontal direction at a constant pitch. A column space 31 that is a discharge space defined by neighboring partitions is continuous over all display lines. The inner surface of the back side including the above of the address electrodes A and the sides of the partitions 29 is covered with red, green and blue colors of fluorescent material layers 28R, 28G and 28B of a color display. Italic letters (R, G and B) indicate light emission colors of the fluorescent materials. The fluorescent material layers 28R, 28G and 28B are excited locally by ultraviolet rays emitted by the discharge gas and emit light.

As shown in FIG. 3, each of the partitions 29 meanders so as to form a column space having wide portions and narrow portions arranged alternately, and a position of the wide portion in the column direction is shifted by half of a cell pitch in the column direction from that of the neighboring column space. The cell that is a display element is formed at each of the wide portions. In FIG. 3, cells 51, 52 and 53 of one display line are shown as representatives by chain lines. The display line is a set of cells to be lighted when a line having a minimum width (i.e., a width of a pixel) in the horizontal direction is displayed.

Figure 4:
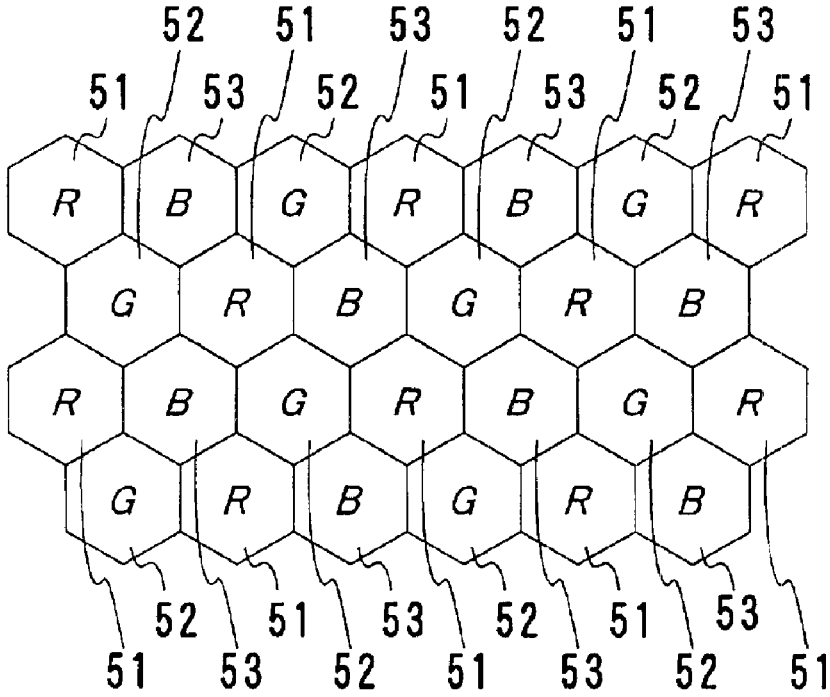
FIG. 4 is a schematic diagram of cell arrangement.
Figure 5:
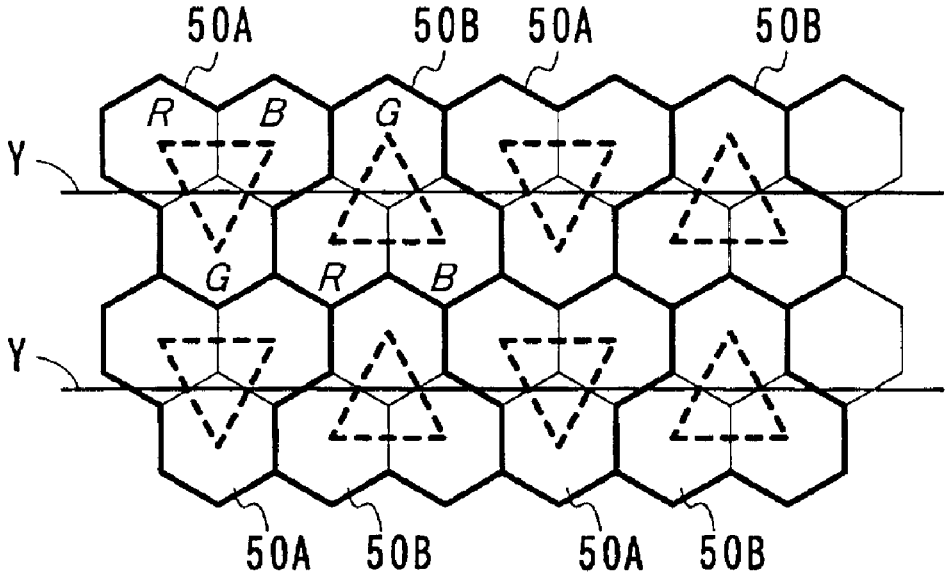
FIG. 5 is a diagram showing a structure of a pixel of a color display.

FIG. 4 is a schematic diagram of cell arrangement. FIG. 5 is a diagram showing a structure of a pixel of a color display.

In FIG. 4, light emission color of a cell 51 is red (R), light emission color of a cell 52 is green (G) and light emission color of a cell 53 is blue (B). As shown in FIG. 4, in the PDP 1, the cells in a column that is a set of cells corresponding to the column space, i.e., the cells arranged linearly in the vertical direction have the same color. The color of a cell column is different from that of the neighboring cell column, and the cell position in the column direction is shifted from that of the neighboring cell column regarding a set of cell columns having the same color (e.g., a set of red cells 51).

As shown in FIG. 5, the display screen is divided in the vertical direction by two rows each and in the horizontal direction by three columns each, so that pixels 50A and 50B are made of three cells. One of the two pixels 50A and 50B neighboring in the horizontal direction, i.e., the pixel 50A makes a cell group having a triangular arrangement in an inverse triangle. The other pixel 50B makes a cell group having a triangular arrangement in a normal three-square. The pixel 50A includes a red cell and a blue cell whose centers are positioned at the upper side of the display electrode Y as a scan electrode and a green cell whose center is positioned at the lower side of the display electrode Y. On the contrary, the pixel 50B includes a green cell whose center is positioned at the upper side of the display electrode Y and a red cell and a blue cell whose centers are positioned at the lower side of the display electrode Y. Hereinafter, the red cell of the pixel 50A, the blue cell of the pixel 50A and the green cell of the pixel 50B are referred to as "upper shift cells", and the green cell of the pixel 50A, the red cell of the pixel 50B and the blue cell of the pixel 50B are referred to as "lower shift cells".

The following explanation is about a lighting control of a color image display using the PDP 1 having the delta arrangement display screen.

Figure 6:
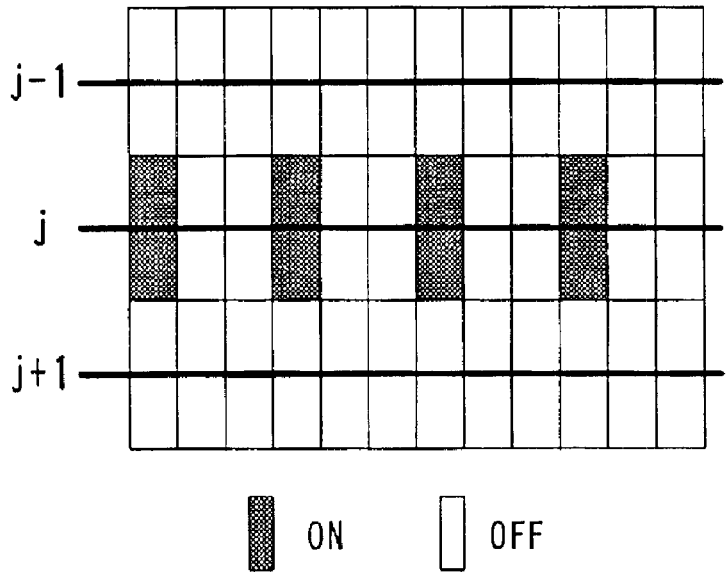
FIG. 6 shows a lighting pattern in an imaginary display screen.

FIG. 6 shows a lighting pattern in an imaginary display screen. The illustrated imaginary display screen is a square arrangement display screen in which cells are aligned both in the horizontal direction and in the vertical direction. This cell arrangement corresponds to a pixel arrangement of an input image to be displayed. In FIG. 6, only one color cell (e.g., a red color cell) out of the j-th display line is lighted, thereby a line in the horizontal direction is displayed.

In the display by the delta arrangement display screen (hereinafter, referred to as a real display screen), cell position relationship between the imaginary display screen and the real display screen is used for lighting control of a predetermined cell.

Figure 7:
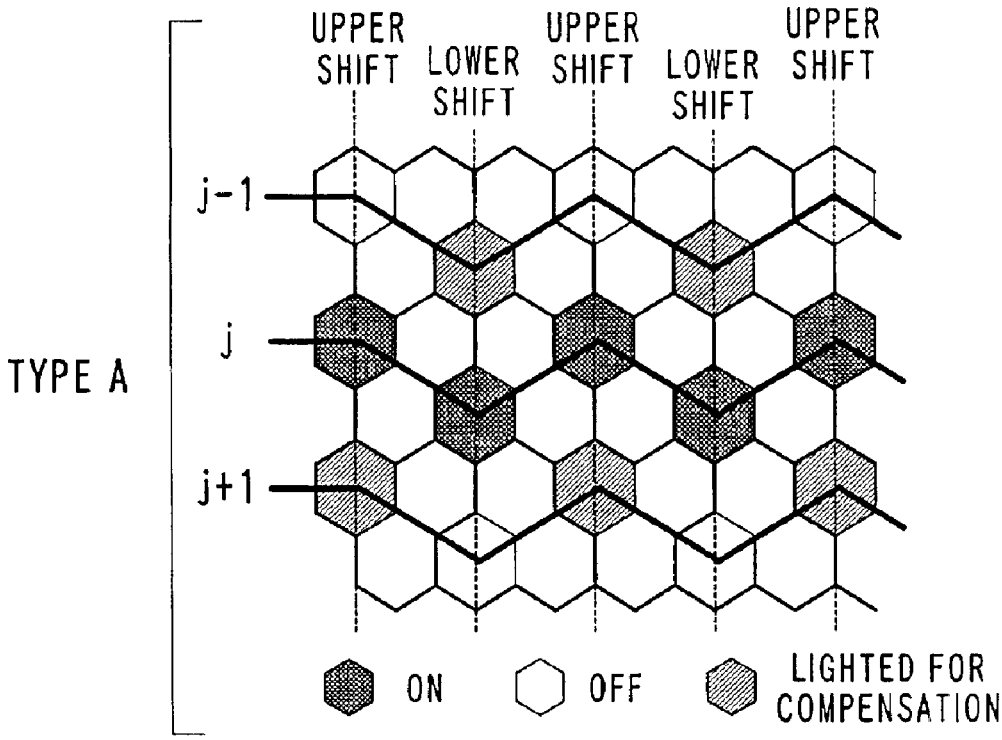
FIG. 7 shows a lighting pattern of Type A according to the present invention.

FIG. 7 shows a lighting pattern of Type A according to the present invention.

In the Type A, a cell corresponding to the lighted cell of the imaginary display screen (which is called an original cell) is lighted, and a cell neighboring the original cell in the vertical direction is lighted for compensation regardless of that the original cell is either the upper shift cell or the lower shift cell. If the original cell is a red or blue upper shift cell, the subjacent cell is lighted for compensation. If the original cell is a green lower shift cell, the upward adjacent cell is lighted for compensation. In addition, if the original cell is a red or a blue lower shift cell, the upward adjacent cell is lighted for compensation. If the original cell is a green upper shift cell, the subjacent cell is lighted for compensation.

Figure 8:
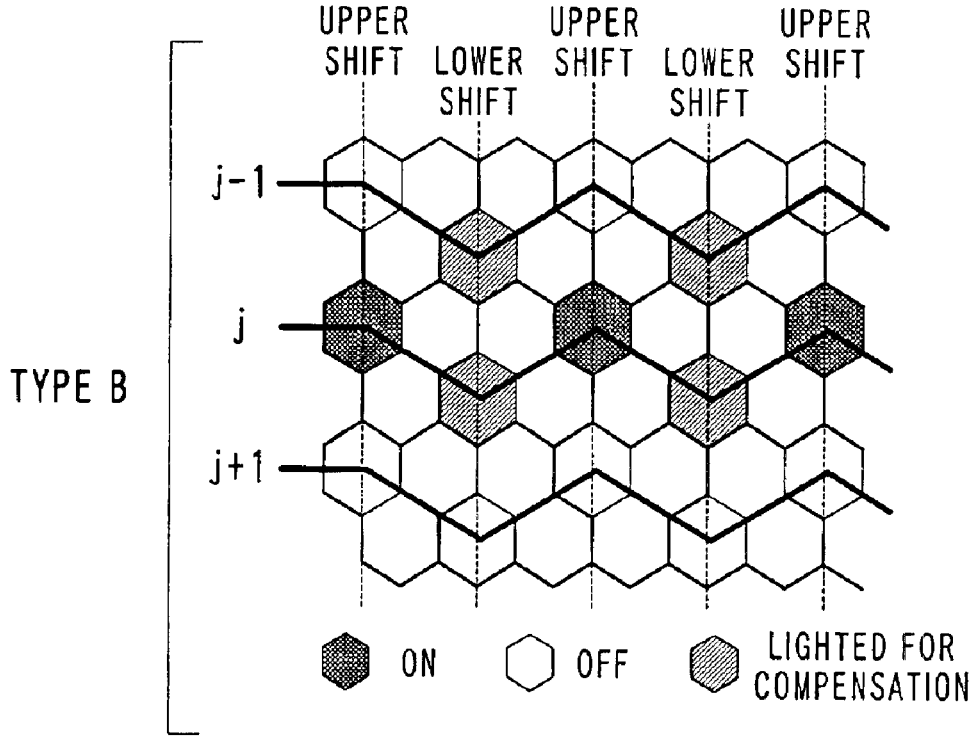
FIG. 8 shows a lighting pattern of Type B according to the present invention.

FIG. 8 shows a lighting pattern of Type B according to the present invention.

In the Type B, the original cell is lighted, and concerning either the upper shift cell or the lower shift cell the neighboring cell is lighted for compensation. As an example thereof, FIG. 8 shows a red cell lighting pattern in the case where the upper shift cell maintains the original lighting state, and only for the lower shift cell the original cell and the upward adjacent cell are lighted for compensation. Concerning the other colors, i.e., a green or a blue cell, a cell to be lighted for compensation is determined in accordance with the position relationship, so that similar lighting pattern can be realized.

Figure 9:
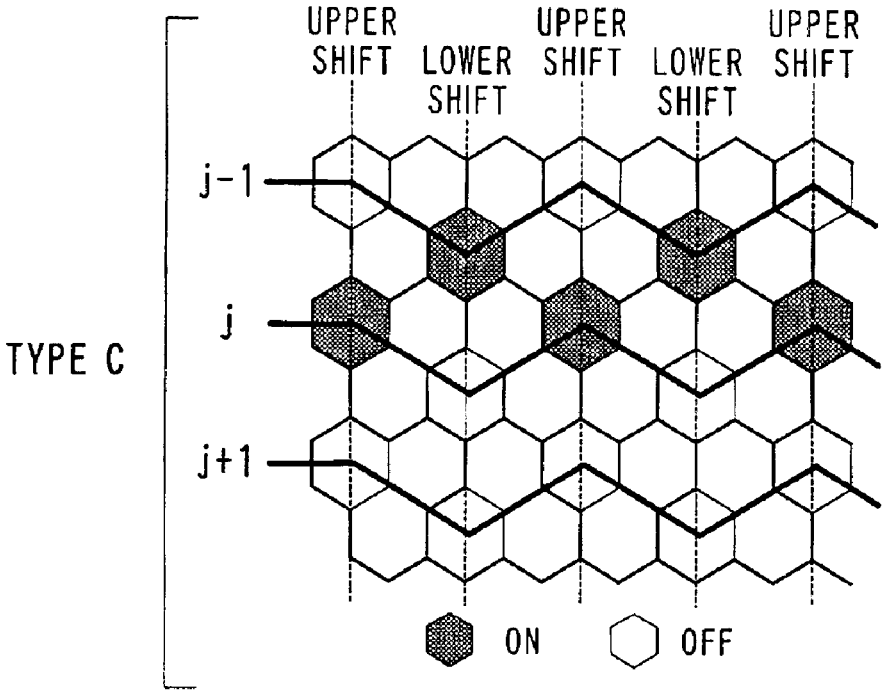
FIG. 9 shows a lighting pattern of Type C according to the present invention.

FIG. 9 shows a lighting pattern of Type C according to the present invention.

In the Type C, either the upper shift cell or the lower shift cell out of the original cells is lighted, and concerning the remaining original cells the neighboring cell is lighted. As an example thereof, FIG. 9 shows a red cell lighting pattern in the case where the original lighting state is maintained if the original cell is an upper shift cell, while if it is a lower shift cell, the upward adjacent cell is lighted at the same luminance as the original cell. Concerning the other colors, i.e., a green or a blue cell, a cell to be lighted for compensation is determined in accordance with the position relationship, so that similar lighting pattern can be realized.

Figure 10:
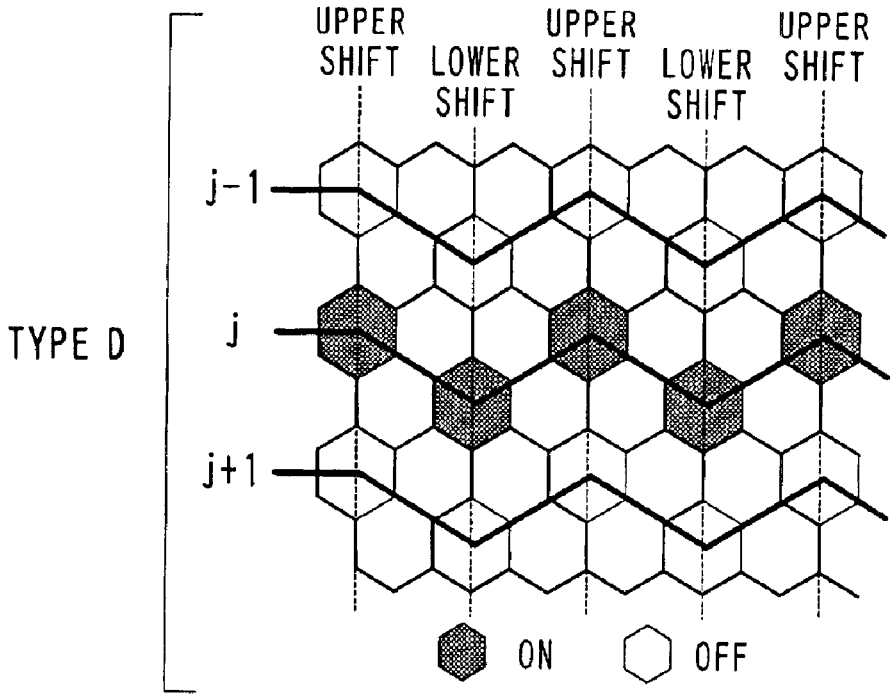
FIG. 10 shows a lighting pattern of Type D according to the present invention.

FIG. 10 shows a lighting pattern of Type D according to the present invention.

The Type D has a lighting control form in which the original cell is lighted without modification, i.e., a similar lighting control form to the conventional method.

In the Type A, the Type B and the Type C, lighting luminance of the cell making the display line is determined by distributing the original lighting luminance, i.e., luminance values of pixels of the input image to one or more cells corresponding to the pixel, or integrating the same.

For example, in the case of the Type C, when the ratio of the lower shift cell lighting luminance and the lower shift cell upward adjacent (or subjacent) cell lighting luminance is 1:0 in the original input image, the original luminance value is distributed so that the ratio of the lower shift cell lighting luminance and the lower shift cell upward adjacent (or subjacent) lighting luminance is 0:1.

In the Type B, when the ratio of the lower shift cell lighting luminance and the lower shift cell upward adjacent (or subjacent) cell lighting luminance is 1:0 in the original input image, the original luminance value is distributed to each cell equally so that the ratio of the lower shift cell lighting luminance and the lower shift cell upward adjacent (or subjacent) lighting luminance is 0.5:0.5.

In the same way, in the case of the Type A, when the ratio of the upper shift cell lighting luminance and the upper shift cell subjacent (or upward adjacent) cell lighting luminance is 1:0, and when the ratio of the lower shift cell lighting luminance and the lower shift cell upward adjacent (or subjacent) cell lighting luminance is 1:0 in the original input image, the original luminance value is distributed to each cell so that the ratio of the upper shift cell lighting luminance and the upper shift cell subjacent (or upward adjacent) cell lighting luminance is a:b (a and b are any numbers), and the ratio of the lower shift cell lighting luminance and the lower shift cell upward adjacent (or subjacent) cell lighting luminance is a:b.

The selection of the upward adjacent or the subjacent cell is determined by the position of the lighted cell in the imaginary display screen and the light emission color. In this example, the above explanation is the case where the cell column is divided into two groups in the cell arrangement shown in FIG. 3. However, a similar lighting pattern to the Type A, B, C or D can be realized even if the cell column is divided into three or more groups.

As a method of distributing or integrating the luminance values of pixels of the input image, there is an operational method in which the convolution process that is a conventional image processing technique is adopted.

Figure 11:
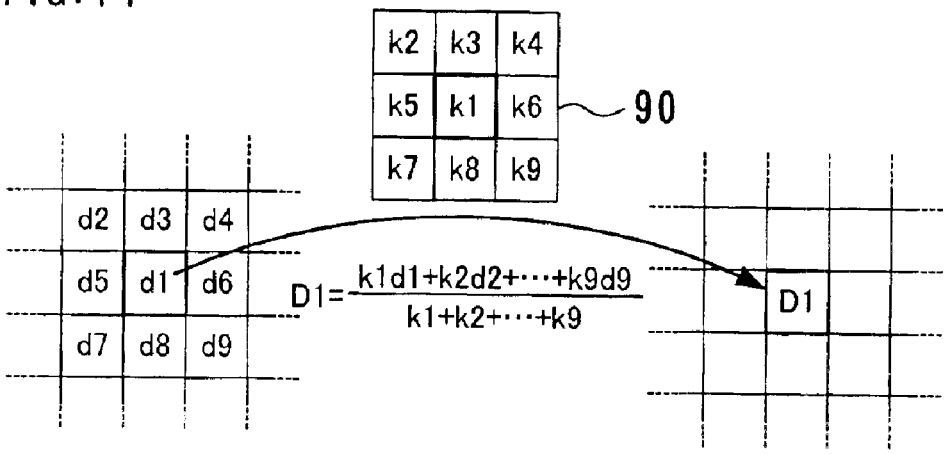
FIG. 11 shows a concept of a convolution process.

FIG. 11 shows a concept of the convolution process.

In the illustrated convolution process, luminance values d1–d9 of 9 pixels including the noted pixel and the surrounding pixels are read from the inputted image signal information, and the display luminance value D1 of the noted pixel is calculated by adopting the operational matrix 90 in which coefficients k1–k9 are determined for each pixel position. The operational equation is D1=(k1d1+k2d2+k3d3+k4d4+k5d5+k6d6+k7d7+k8d8+k9d9)/(k1+k2+k3+k4+k5+k6+k7+k8+k9). By selecting appropriate coefficients k1–k9, various lighting patterns can be obtained. When adopting the process, it is important to exchange the group of coefficients k2, k3 and k4 and the group of coefficients k7, k8 and k9 for the operation process if necessary, in accordance with the shift state of the noted pixel (the upper shift cell or the lower shift cell).

The operational matrix 90 is not limited to the illustrated one. For example, it can be one whose target is three pixels including the noted pixel and the upward adjacent and subjacent pixels, three pixels including the noted pixel and horizontally neighboring pixels, four pixels including the noted pixel and upward adjacent and the neighboring pixels, or four pixels including the noted pixel and subjacent and the neighboring pixels. It is possible to use an operational method except the convolution process.

By adopting the Type A or the Type B lighting pattern for the display, the zigzag feature that has been a problem can be reduced. Subjective evaluation test is carried out in which ten testers evaluated the displayed character image, and all the testers answered that the display line had become smooth. The Type A and the Type B can be applied to both the interlace image and the non-interlace image of the display.

If the input image is an interlace format, one of the two fields of the frame is displayed by the Type C, and the other field is displayed by the Type D, so that the same lighting state as in the Type B is realized. Therefore, even the combination of the Type C and the Type D can reduce the zigzag feature of a line display. This display method combining the Type C and the Type D can be applied when the input image is an interlace display signal. In addition, this method also has an effect that a high definition image having resolution more than the number of the scan electrodes formed within the PDP actually can be displayed.

Next, the relationship between a type of the input image and a lighting pattern will be explained. In a PDP having the cell arrangement shown in FIG. 3, the zigzag feature of a line is observed conspicuously when a character is displayed. Especially, the problem is serious in a computer image display in which static images are major display contents. Therefore, it is desirable to select the Type A–D lighting patterns appropriately for adapting it to the display. On the other hand, in a television broadcast in which moving picture images are major display contents, the zigzag feature is not so conspicuous as in the computer image display. In the case of a BS digital broadcast in which moving picture displays and static character displays are mixed, the zigzag feature of a display line is observed conspicuously similarly to the case of the computer image display. Therefore, it is desirable to select the Types A–D lighting patterns appropriately for adapting it to the display. The input image decision portion and the operational process portion for controlling the above-mentioned lighting patterns can be incorporated into the above-mentioned data conversion circuit 712 shown in FIG. 1.

Figure 12:
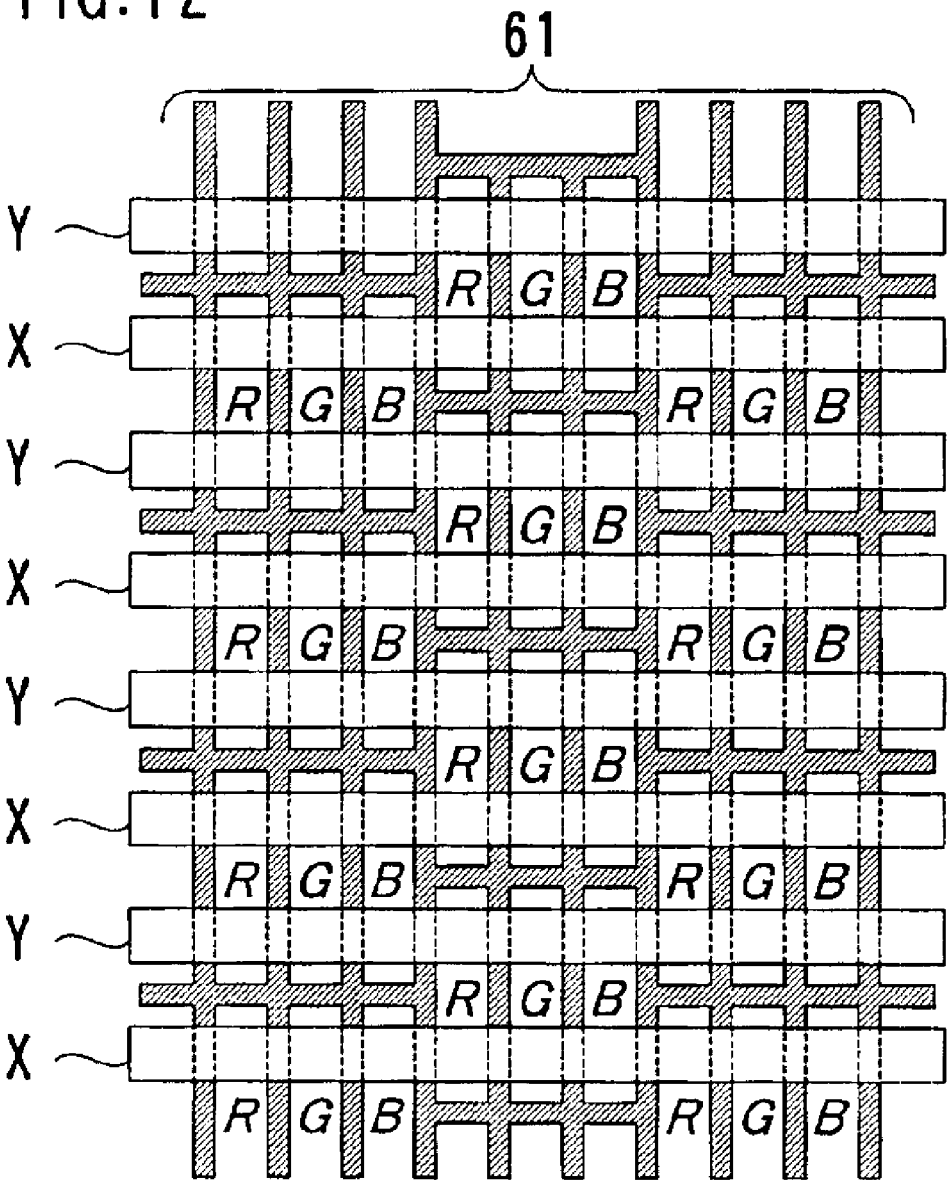
FIG. 12 shows another example of the partition pattern.

The present invention can be applied to a display device in which the display screen of the delta arrangement is structured by the partitions 61 as a set of linear band-like walls as shown in FIG. 12, without limiting to a device having meandering partitions.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for displaying a color image by reproducing a pixel color of an input image using three types of cells having different light colors, that method comprising the steps of:

using a display device including a display screen having parallel cell columns, cells of each cell column having the same light color, a light color of a cell column being different from that of the neighboring cell column, a cell position in the column direction of a cell column being shifted from that of the neighboring cell column among a set of cell columns each having the same light color; and lighting two neighboring cells in at least one cell column out of a set of cell columns each having the same light color when displaying a display line perpendicular to the column direction, wherein, in a display line, one of:

a cell neighboring an original cell in a vertical direction is lighted for compensation in an upward adjacent or subjacent cell according to a predetermined scheme;

when the original cell is an upper shift cell, neighboring lower shift cells are lighted for compensation and when the original cell is a lower shift cell, neighboring upper shift cells are lighted for compensation; and when the original cell is an upper shift cell, a neighboring lower shift cell is lighted for compensation and when the original cell is a lower shift cell, a neighboring upper shift cell is lighted for compensation.

2. The method according to claim 1, wherein two neighboring cells are lighted in all the plural cell columns having the same light color corresponding to the display line.

3. The method according to claim 1, wherein two neighboring cells are lighted in every other cell columns having the same light color, and one cell is lighted in the remaining cell columns.

4. The method according to claim 1, wherein luminance of each cell is determined by distributing a luminance value of a pixel of the input image to two neighboring cells equally when lighting the two cells in the cell column.

5. The method according to claim 1, wherein the display device is a plasma display panel.

6. The method according to claim 1, wherein luminance of each cell is determined by distributing a luminance value of a pixel of the input image to two neighboring cells when lighting the two cells in the cell column.

7. The method according to claim 1, wherein two neighboring cells are lighted in all the plural cell columns having the same light color corresponding to the display line when the input image is a non-interlace image.

8. The method according to claim 1, wherein two neighboring cells are lighted in every other cell columns having the same light color, and one cell is lighted in the remaining cell columns when the input image is a non-interlace image.

9. A display device comprising:

a display device including a display screen having parallel cell columns, cells of each cell column having the same light color, a light color of a cell column being different from that of the neighboring cell column, a cell position in the column direction of a cell column being shifted from that of the neighboring cell column among a set of the cell columns each having the same light color; and a driving circuit including a portion for deciding whether an input image is a non-interlace image or an interlace image and a portion for controlling a combination of cells having the same light color in accordance with a result of the decision with respect to the input image, wherein, in a display line, one of:

a cell neighboring an original cell in a vertical direction is lighted for compensation in an upward adjacent or subjacent cell according to a predetermined scheme;

when the original cell is an upper shift cell, neighboring lower shift cells are lighted for compensation and when the original cell is a lower shift cell, neighboring upper shift cells are lighted for compensation; and when the original cell is an upper shift cell, a neighboring lower shift cell is lighted for compensation and when the original cell is a lower shift cell, a neighboring upper shift cell is lighted for compensation.

10. A display device comprising:

a display device including a display screen having parallel cell columns, cells of each cell column having a same light color, a light color of a cell column being different from that of the neighboring cell column, a cell position in the column direction of a cell column being shifted from that of the neighboring cell column among a set of the cell columns each having the same light color; and a driving circuit for lighting two neighboring cells in at least one cell column having the same light color when displaying a display line perpendicular to the column direction, wherein, in a display line, one of:

a cell neighboring an original cell in a vertical direction is lighted for compensation in an upward adjacent or subjacent cell according to a predetermined scheme;

when the original cell is an upper shift cell, neighboring lower shift cells are lighted for compensation and when the original cell is a lower shift cell, neighboring upper shift cells are lighted for compensation; and when the original cell is an upper shift cell, a neighboring lower shift cell is lighted for compensation and when the original cell is a lower shift cell, a neighboring upper shift cell is lighted for compensation.

11. A method for displaying a color image by reproducing a pixel color of an input image using three types of cells having different light colors, the method comprising:

using a display device including a display screen having parallel cell columns, cells of each cell column having a same light color, a light color of a cell column being different from that of the neighboring cell column, a cell position in a column direction of a cell column being shifted from that of the neighboring cell column among a set of cell columns each having the same light color; and switching a combination of cells having the same light color constituting display line perpendicular to the column direction for each of a first field and a second field when the input image is displayed in an interlace format, wherein in the first field, lighting two neighboring cells in at least one cell column out of a set of cell columns each having the same light color when displaying a display line perpendicular to the column direction, and when the original cell is an upper shift cell, a neighboring lower shift cell is lighted for compensation and when the original cell is a lower shift cell, a neighboring upper shift cell is lighted for compensation, and in the second field, lighting the original cell when displaying a display line perpendicular to the column direction.

* * * * *

UNITED STATES PATENT AND TRADEMARK OFFICE

CERTIFICATE OF CORRECTION

PATENT NO. : 6,897,835 B2
DATED : May 24, 2005
INVENTOR(S) : Katsuya Irie et al.

It is certified that error appears in the above-identified patent and that said Letters Patent is hereby corrected as shown below:

Column 7,
Line 40, change “that” to -- the --.

Column 10,
Line 2, after “constituting” insert -- a --.

Signed and Sealed this

Twenty-first Day of March, 2006

JON W. DUDAS
*Director of the United States Patent and Trademark Office*